US009783953B2

(12) United States Patent
Gross et al.

(10) Patent No.: US 9,783,953 B2
(45) Date of Patent: Oct. 10, 2017

(54) BAIL ASSEMBLY

(71) Applicant: Harnischfeger Technologies, Inc., Wilmington, DE (US)

(72) Inventors: Matthew L. Gross, West Allis, WI (US); Joseph J. Colwell, Hubertus, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 311 days.

(21) Appl. No.: 13/937,551

(22) Filed: Jul. 9, 2013

(65) Prior Publication Data

US 2014/0007466 A1 Jan. 9, 2014

Related U.S. Application Data

(60) Provisional application No. 61/669,388, filed on Jul. 9, 2012.

(51) Int. Cl.

| | |
|---|---|
| ***E02F 3/60*** | (2006.01) |
| ***E02F 3/47*** | (2006.01) |
| ***E02F 3/58*** | (2006.01) |

(52) U.S. Cl.

CPC ..... *E02F 3/60* (2013.01); *E02F 3/47* (2013.01); *E02F 3/58* (2013.01)

(58) Field of Classification Search

CPC ..... E02F 3/427; E02F 3/47; E02F 3/60; E02F 3/58

See application file for complete search history.

(56) References Cited

U.S. PATENT DOCUMENTS

| | | | | |
|---|---|---|---|---|
| 671,014 A | | 4/1901 | Council | |
| 1,008,247 A | * | 11/1911 | Dowd | 37/396 |
| 1,609,372 A | * | 12/1926 | Lichtenberg | 414/726 |
| 1,832,493 A | | 11/1931 | Marsilius | |
| 2,034,854 A | | 3/1936 | Younie | |
| 2,109,195 A | * | 2/1938 | Green | 172/26.5 |
| 2,947,430 A | * | 8/1960 | Schneider | 414/690 |

(Continued)

FOREIGN PATENT DOCUMENTS

| | | |
|---|---|---|
| CA | 2333835 | 8/2001 |
| EP | 250618 | 12/1988 |

(Continued)

OTHER PUBLICATIONS

First Office Action from the State Intellectual Property Office of China for Application No. 201310286994.3 dated Sep. 21, 2016 (19 pages).

(Continued)

*Primary Examiner* — Robert Pezzuto
*Assistant Examiner* — Jessica H Lutz
(74) *Attorney, Agent, or Firm* — Michael Best & Friedrich LLP

(57) ABSTRACT

A shovel includes a dipper, a hoist rope supporting the dipper, and a bail assembly. The bail assembly includes a bail configured to be coupled to the dipper and an equalizer including a mounting block configured to receive a portion of the hoist rope. The bail is pivotable about a bail axis and defines a first side. The equalizer is pivotably coupled to the bail. The equalizer is pivotable about an equalizer axis that is parallel to the first side of the bail and is offset from the first side.

29 Claims, 11 Drawing Sheets

(56) References Cited

U.S. PATENT DOCUMENTS

| | | | | |
|---|---|---|---|---|
| 3,608,755 | A * | 9/1971 | Solokhin et al. | 414/690 |
| 3,933,260 | A | 1/1976 | Kronlokken | |
| 4,150,812 | A | 4/1979 | Baron | |
| 4,329,794 | A | 5/1982 | Rogers | |
| 4,597,713 | A * | 7/1986 | Briscoe et al. | 414/690 |
| 5,428,909 | A | 7/1995 | Immel | |
| 5,499,463 | A | 3/1996 | Profio et al. | |
| 5,575,092 | A | 11/1996 | Smit | |
| 6,484,423 | B1 | 11/2002 | Murray | |
| 2011/0088290 | A1 | 4/2011 | Rowlands | |
| 2012/0195729 | A1 | 8/2012 | Hren et al. | |
| 2012/0195730 | A1 | 8/2012 | Hren | |
| 2013/0136570 | A1 * | 5/2013 | Colwell et al. | 414/722 |
| 2013/0195593 | A1 * | 8/2013 | Knuth | 414/697 |
| 2014/0090279 | A1 | 4/2014 | Campbell | |

FOREIGN PATENT DOCUMENTS

| | | |
|---|---|---|
| GB | 2075952 | 11/1981 |
| WO | 2008034171 | 3/2008 |
| WO | 2010141007 | 12/2010 |

OTHER PUBLICATIONS

First Office Action from the Intellectual Property Office of Australia for Application No. 2013206737 dated Sep. 12, 2016 (3 pages).
First Office Action from the Intellectual Property Office of Australia for Application No. 2013206737 dated May 24, 2017 (5 pages).

* cited by examiner

BAIL ASSEMBLY

CROSS-REFERENCE TO RELATED APPLICATIONS

This application claims the benefit of U.S. Provisional Patent Application No. 61/669,388, filed Jul. 9, 2012, the entire contents of which are incorporated herein by reference.

BACKGROUND

The present invention relates to the field of earthmoving machines. Specifically, the present invention discloses a bail for a mining shovel.

A conventional rope mining shovel includes a boom, a handle moveably coupled to the boom, a dipper that is coupled to a handle, a bail that is coupled to the dipper, an equalizer that is coupled to a top portion of the bail, and a hoist rope that is coupled to the equalizer. The hoist rope passes over a boom sheave coupled to an end of the boom, and is reeled in and paid out by a hoist drum. The bail provides a rotating connection between the ropes and the dipper, and maintains clearance between the rope and both the dipper and the material in the dipper. The equalizer aligns the hoist rope to be tangent to the boom sheave, reducing wear on the rope.

In general, there are three conventional methods to attach hoist rope to a dipper body supported on a rope shovel. First, a dipper including an equalizer integrally-formed with the dipper increases dump and dig heights at the expense of reduced cutting and dig forces. Alternatively, a dipper including a bail with integral rope mounting blocks improves cutting forces. This configuration compromises rope life, however, due to bending of the ropes at the bail connection when the bail rotates forward while the ropes are slack. Third, a dipper including both an equalizer and a bail provides increased cutting forces and an additional pivot point to keep the hoist ropes aligned, but the combination decreases dig and dump heights. As a result, all of the known configurations have a disadvantage with respect to one of these factors (dig/dump heights, cutting force, and rope wear rate).

SUMMARY

In one embodiment, the invention provides a bail assembly for a mining shovel including a hoist rope and a dipper. The bail assembly includes a bail configured to be coupled to the dipper and an equalizer including a mounting block configured to receive a portion of the hoist rope. The bail is pivotable about a bail axis and defines a first side. The equalizer is pivotably coupled to the bail. The equalizer is pivotable about an equalizer axis that is parallel to the first side of the bail and is offset from the first side.

In another embodiment, the invention provides a bail assembly for a mining shovel including a hoist rope and a dipper. The bail assembly includes a bail and an equalizer. The bail includes a pair of arms configured to be coupled to the dipper and a cross-member extending between the arms. The bail is pivotable about a bail axis. The cross-member defines a curved shape such that a center portion of the cross-member extends in a first direction perpendicular with respect to the bail axis. The equalizer includes a mounting block configured to receive a portion of the hoist rope. The equalizer is pivotably coupled to the bail and is pivotable about an equalizer axis that is offset from the center portion of the cross-member in a second direction opposite the first direction toward the bail axis.

In yet another embodiment, the invention provides a dipper assembly for a mining shovel. The shovel includes a hoist rope extending over a boom and coupled to the dipper assembly to raise and lower the dipper assembly. The dipper assembly includes a dipper, a bail, and an equalizer. The dipper includes a dipper body and a dipper door. The dipper body defines a material receiving end and a material discharging end. The dipper door is pivotably coupled to the dipper body to selectively close the material discharging end. The bail is coupled to the dipper body proximate the material receiving end. The bail defines a first side and is pivotable about a bail axis. The equalizer includes a mounting block configured to receive a portion of the hoist rope. The equalizer is pivotably coupled to the bail. The equalizer is pivotable about an equalizer axis that is parallel to the first side of the bail and is offset from the first side.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

Figure 1:
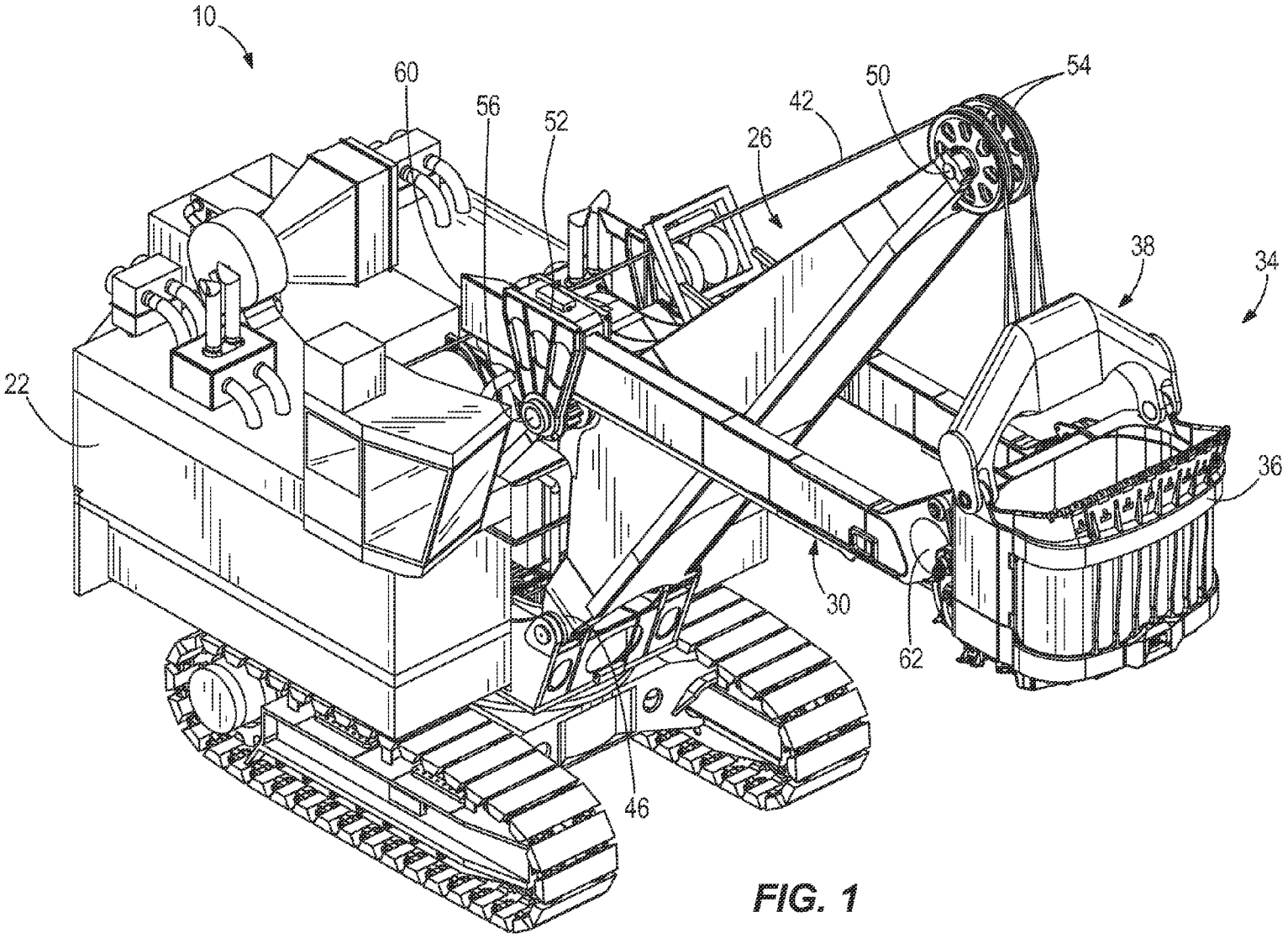
FIG. 1 is a perspective view of a mining shovel.

As shown in FIG. 1, an earthmoving machine such as a mining shovel 10 includes a base 22, a boom 26, an elongated member or handle 30, and a dipper assembly 34 including a dipper 36 and a bail assembly 38 coupled to the dipper 36. The base 22 includes a hoist drum (not shown) for reeling in and paying out a cable or rope 42. The boom 26 includes a first end 46 coupled to the base 22, a second end 50 opposite the first end 46, saddle blocks 52, a boom sheave 54 coupled to the second end 50, and a shipper shaft 56. In the illustrated embodiment, a support member (not shown) limits or dampens the pivoting movement of the boom 26 relative to the base 22. In other embodiments, the boom 26 is supported by a gantry or similar structure.

The handle 30 is moveably coupled to the boom 26 and includes a first end 60 and a second end 62. The first end 60 is movably received in the saddle blocks 52, and the handle passes through the saddle block 52 such that the handle 30 is configured for rotational and translational movement relative to the boom 26. State another way, the handle 30 is linearly extendable relative to the saddle block 52 and is rotatable about the shipper shaft 56.

Figure 2:
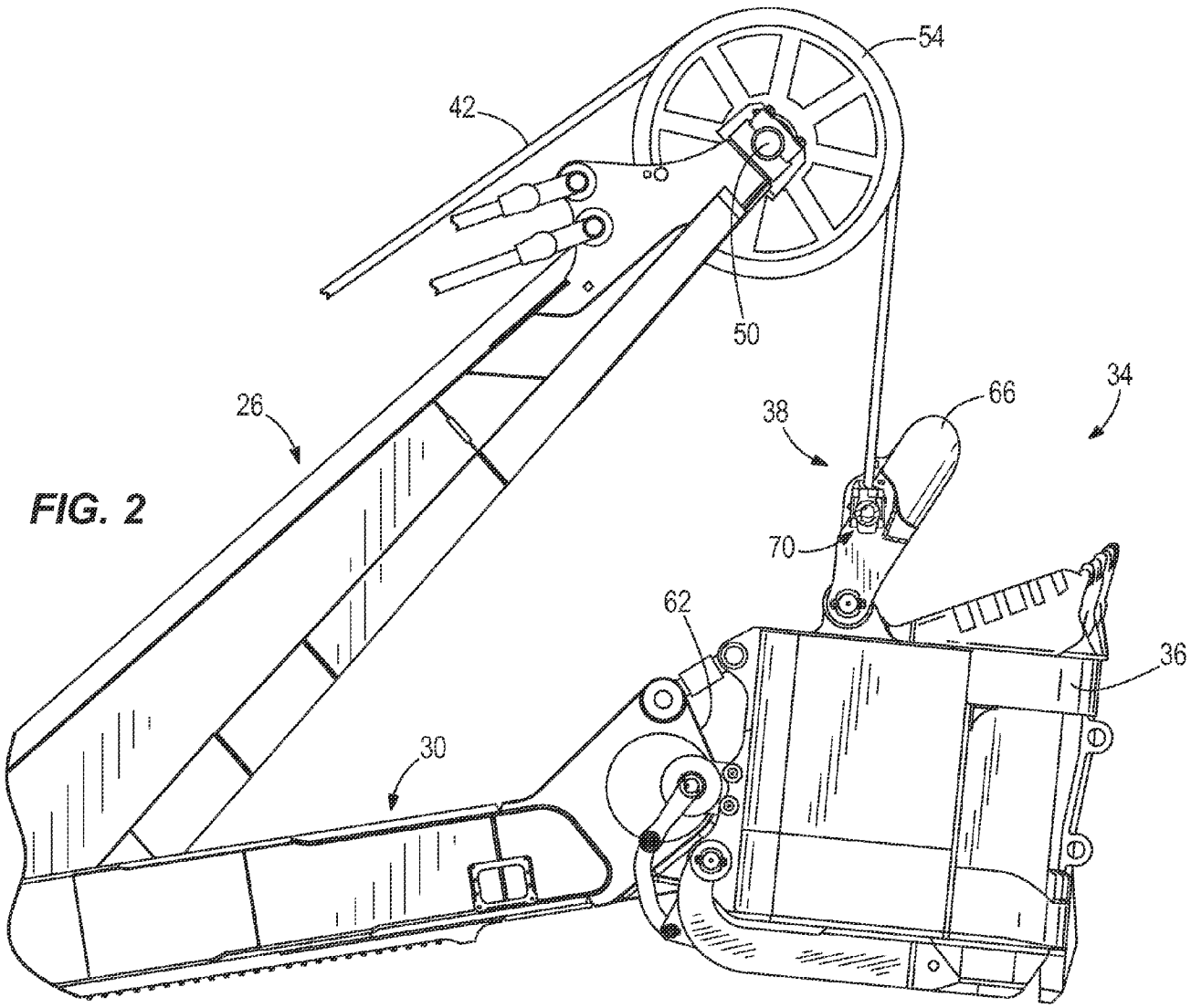
FIG. 2 is an enlarged right side view of a portion of the shovel of FIG. 1.

As shown in FIG. 2, the rope 42 is secured to the hoist drum (not shown), passes over the boom sheave 54, and is coupled to the dipper 36 by the bail assembly 38. The dipper 36 is raised or lowered relative to the boom sheave 54 as the rope 42 is reeled in or paid out, respectively, by the hoist drum. In the illustrated embodiment, the dipper 36 is fixed relative to the handle 30. In other embodiments, the shovel 10 includes a bucket that is pivotable relative to the handle 30 about the second end 62.

Figure 3:
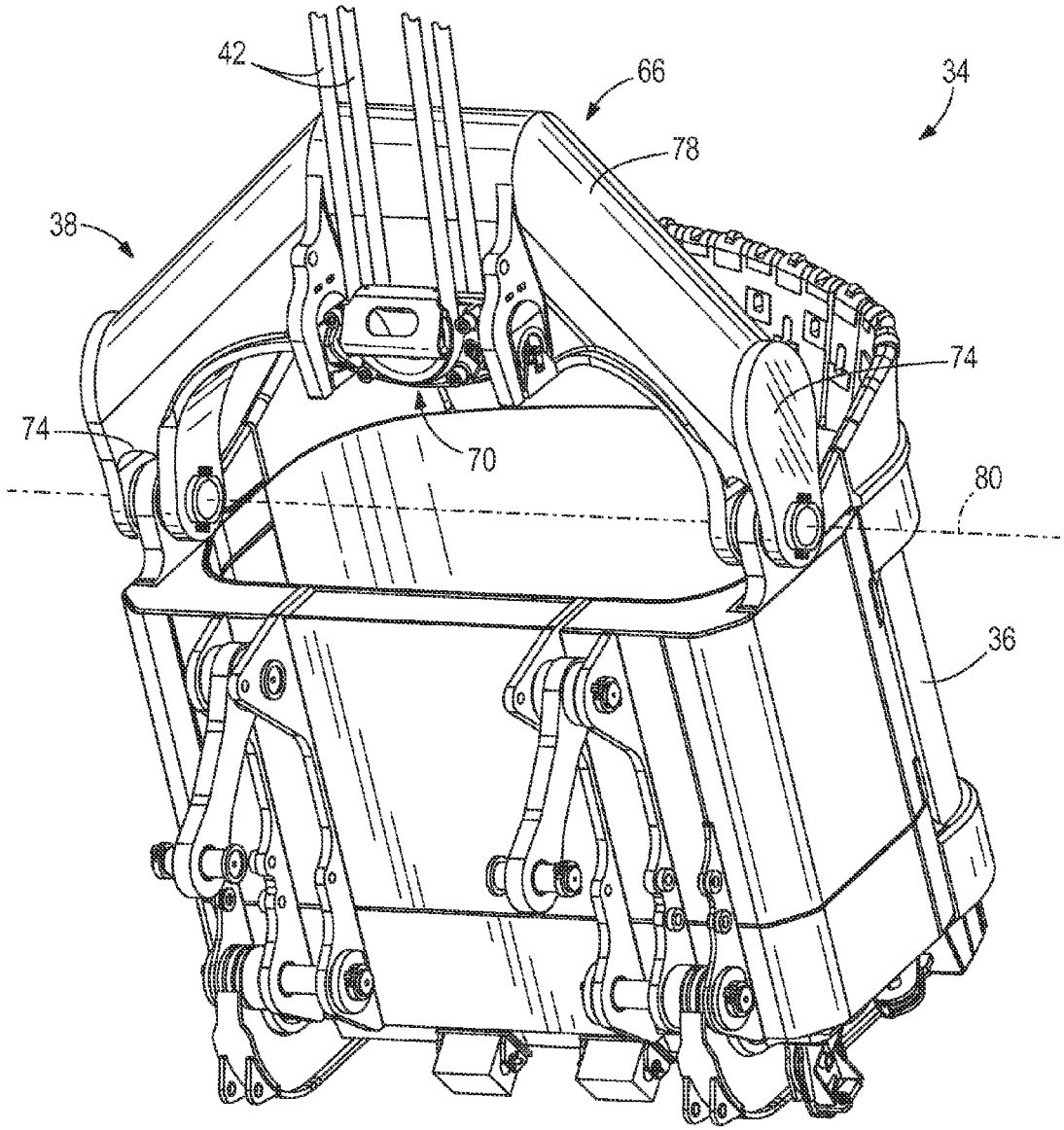
FIG. 3 is a rear perspective view of a dipper assembly.
Figure 4:
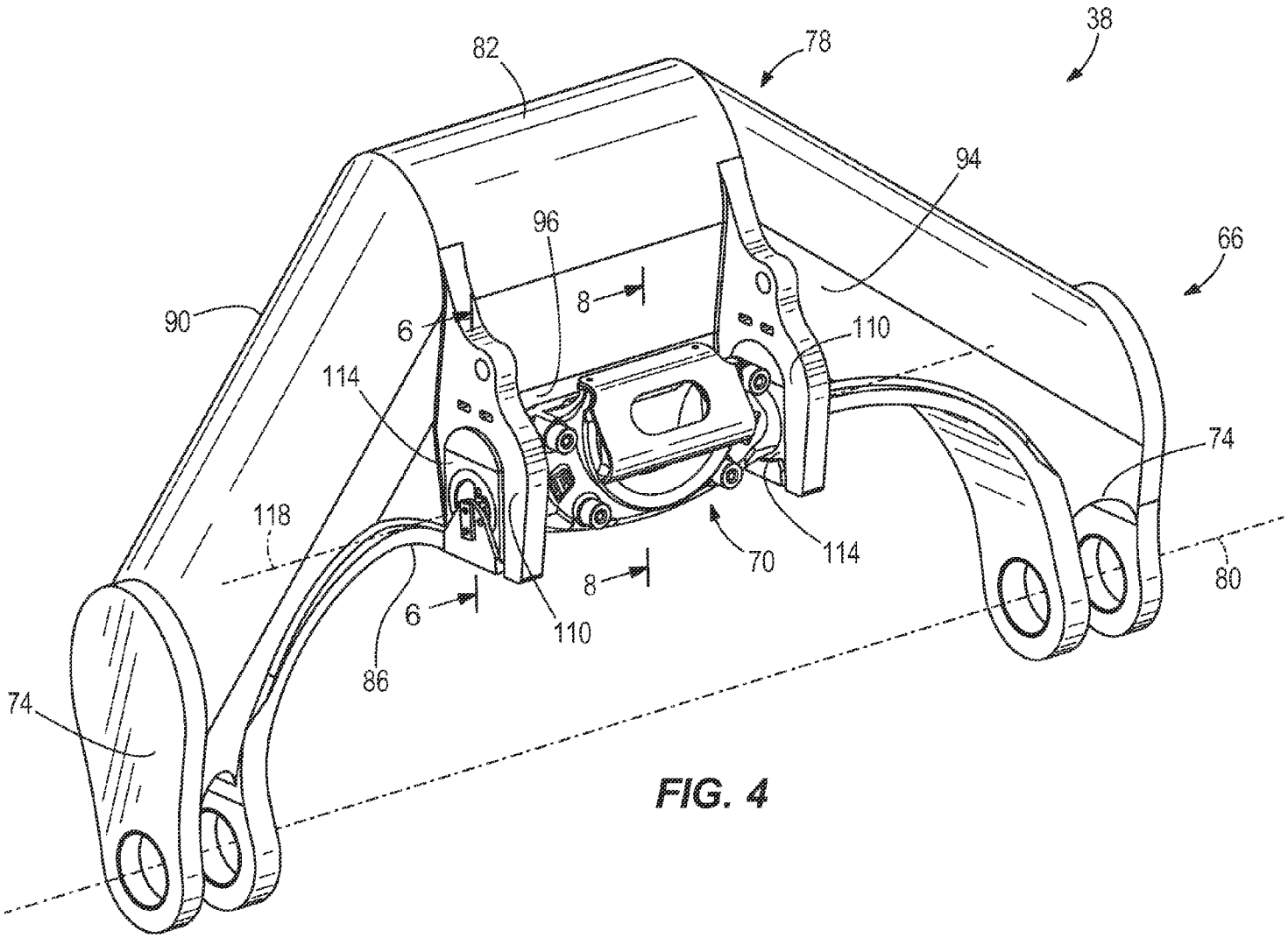
FIG. 4 is a perspective view of a bail assembly.
Figure 5:
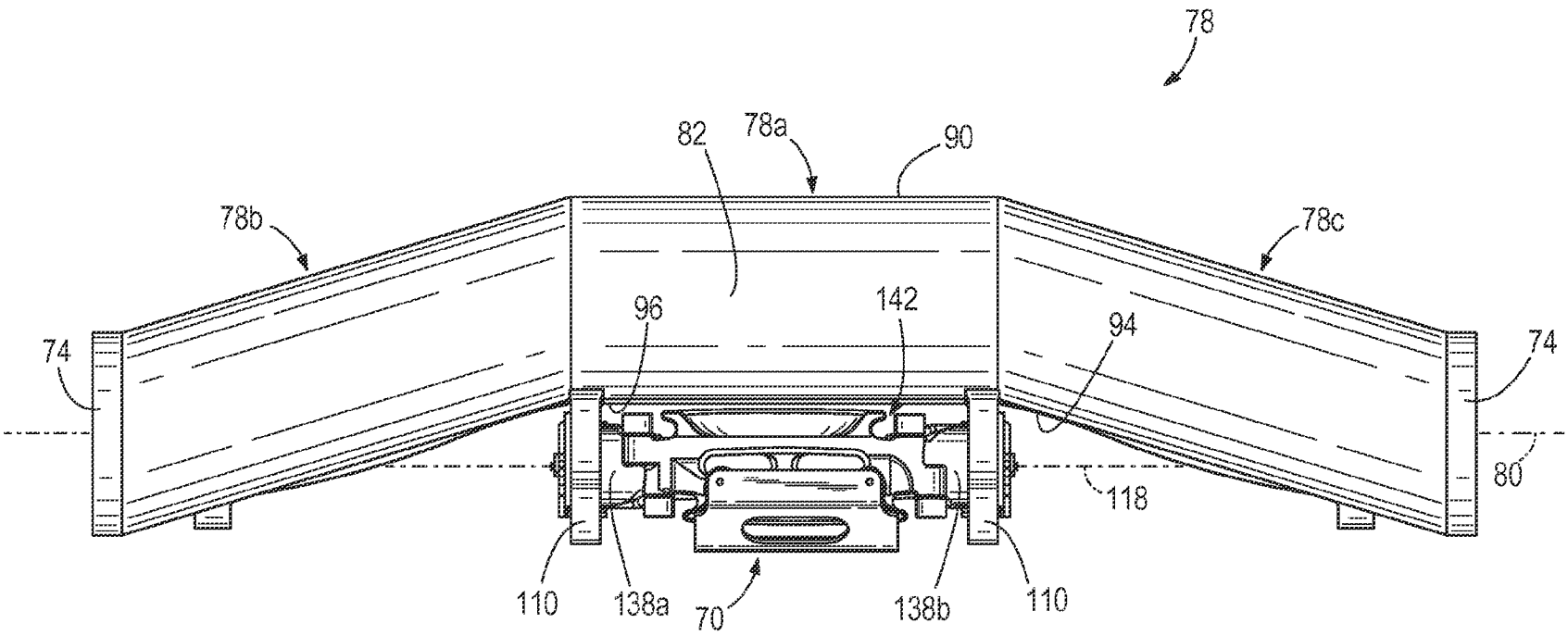
FIG. 5 is a top view of the bail assembly of FIG. 4.

As shown in FIGS. 3 and 4, the bail assembly 38 includes a bail 66 and an equalizer 70. The bail 66 includes a pair of arms 74 pivotably coupled to the dipper 36 (FIG. 3) and a cross-member 78 extending between the arms 74. The arms 74 are rotatable about a bail axis 80. Referring to FIGS. 4 and 5, the cross-member 78 defines a top edge 82, a bottom edge 86 opposite the top edge 82, a first or a bank side 90 facing toward the embankment or bank of material (not shown) to be dug, and a second or non-bank side 94 facing away from the bank of material to be dug. As shown in FIG. 5, the bail 66 has a generally curved shaped such that a center portion 78*a* of the cross-member 78 extends forward of end portions 78*b* and 78*c* positioned proximate the arms 74. That is, the center portion 78*a* extends in a first direction perpendicular to the bail axis 80 such that the center portion 78*a* is laterally positioned farther from the bail axis than the end portions 78*b* and 78*c*. In the illustrated embodiment, a portion of the non-bank side 94 defines a planar surface 96.

Figure 7:
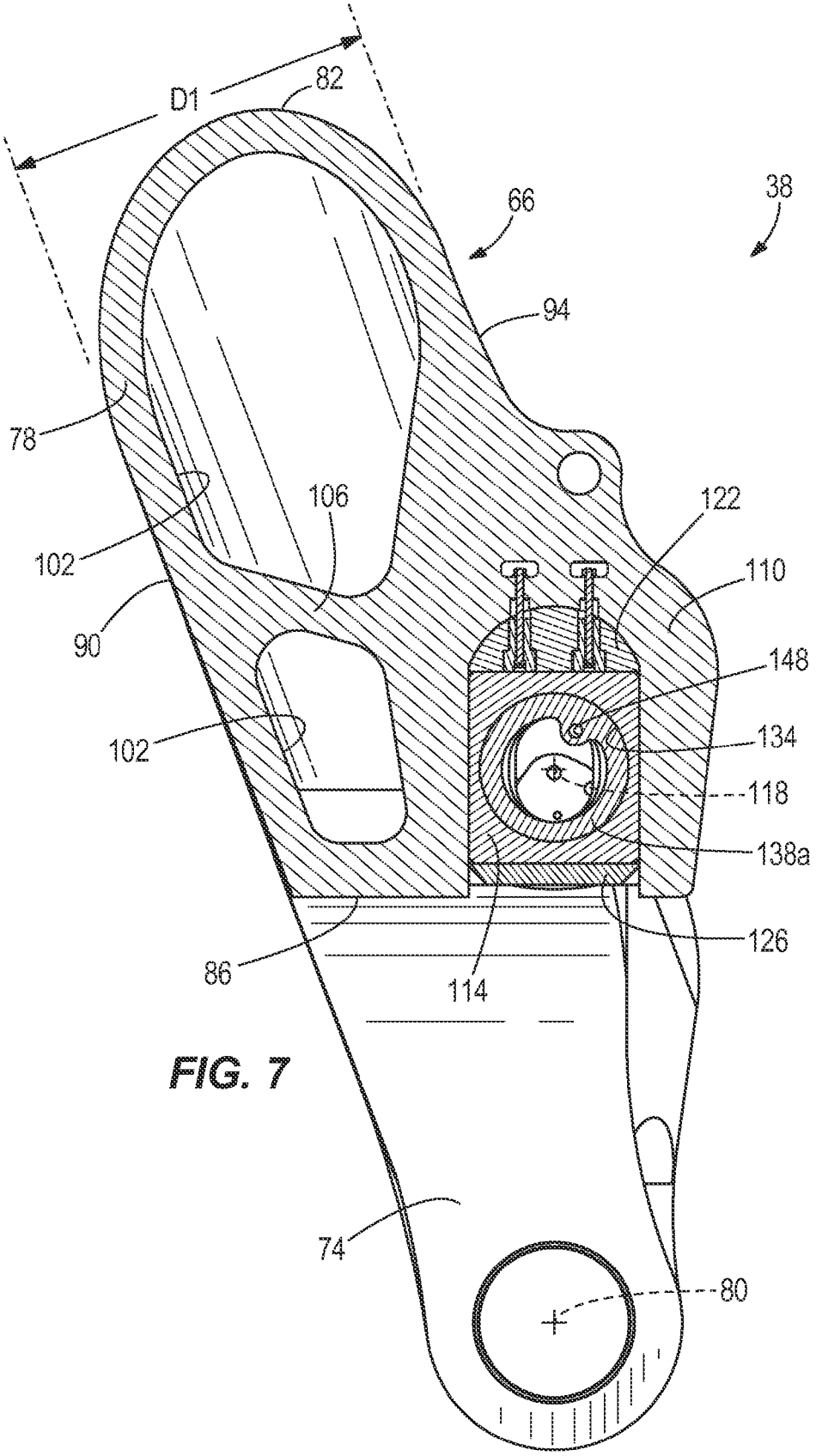
FIG. 7 is a section view of the bail assembly of FIG. 4, viewed along section 6-6.
Figure 9:
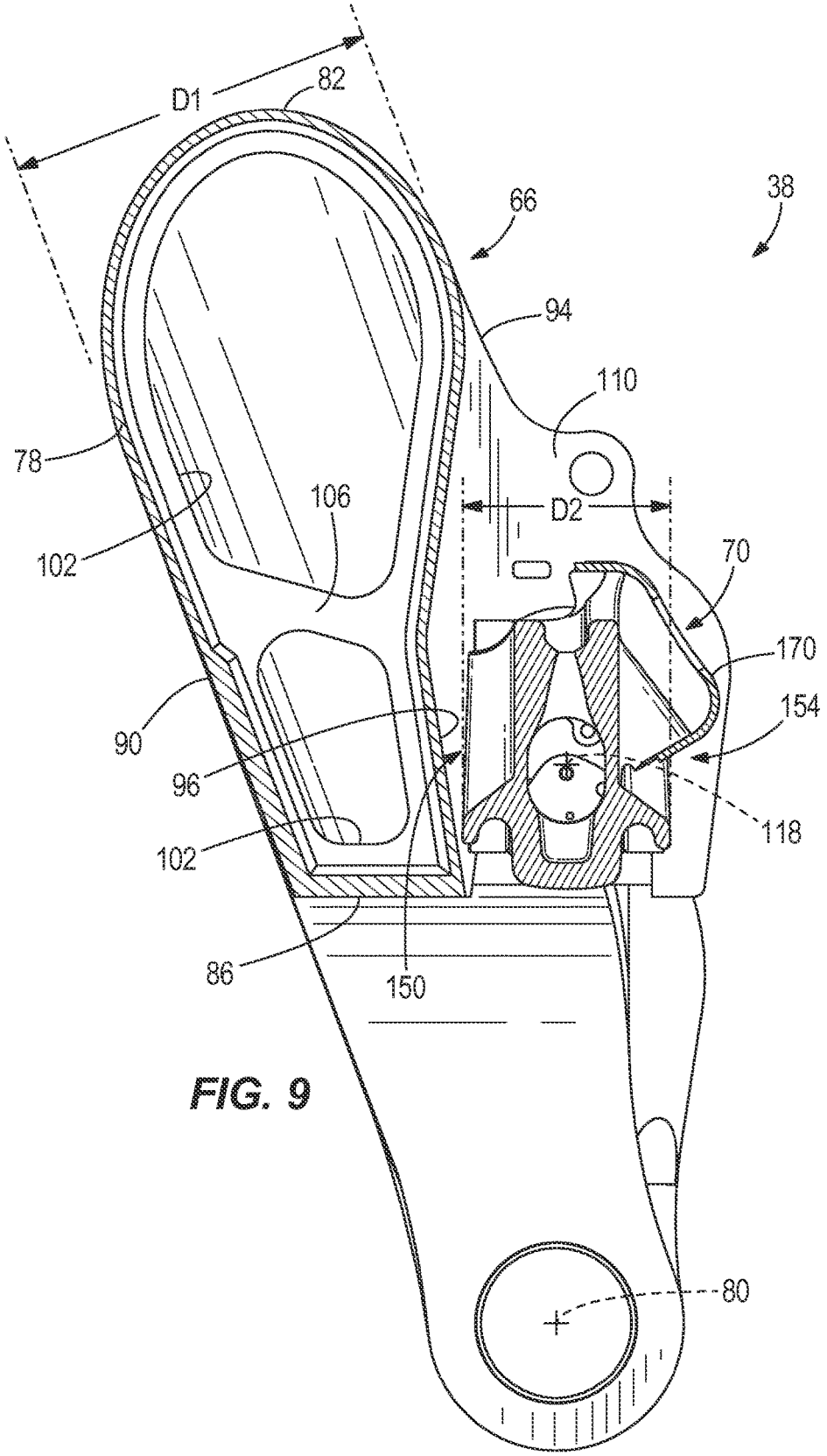
FIG. 9 is a section view of the bail assembly of FIG. 4, viewed along section 8-8.

As best shown in FIG. 7, a distance between the bank side 90 and the non-bank side 94 defines a bail thickness D1. In the illustrated embodiment, the cross-member 78 includes an internal cavity 102 (FIGS. 7 and 9) and brace supports 106 (FIGS. 7 and 9). The cavity 102 reduces the weight of the bail 66, and the braces 106 increase the strength of the bail 66 by reacting to bending and torsional loads that arise due to the positioning of the equalizer 70 on the bail 66 and the resultant forces that arise during a digging operation.

Figure 6:
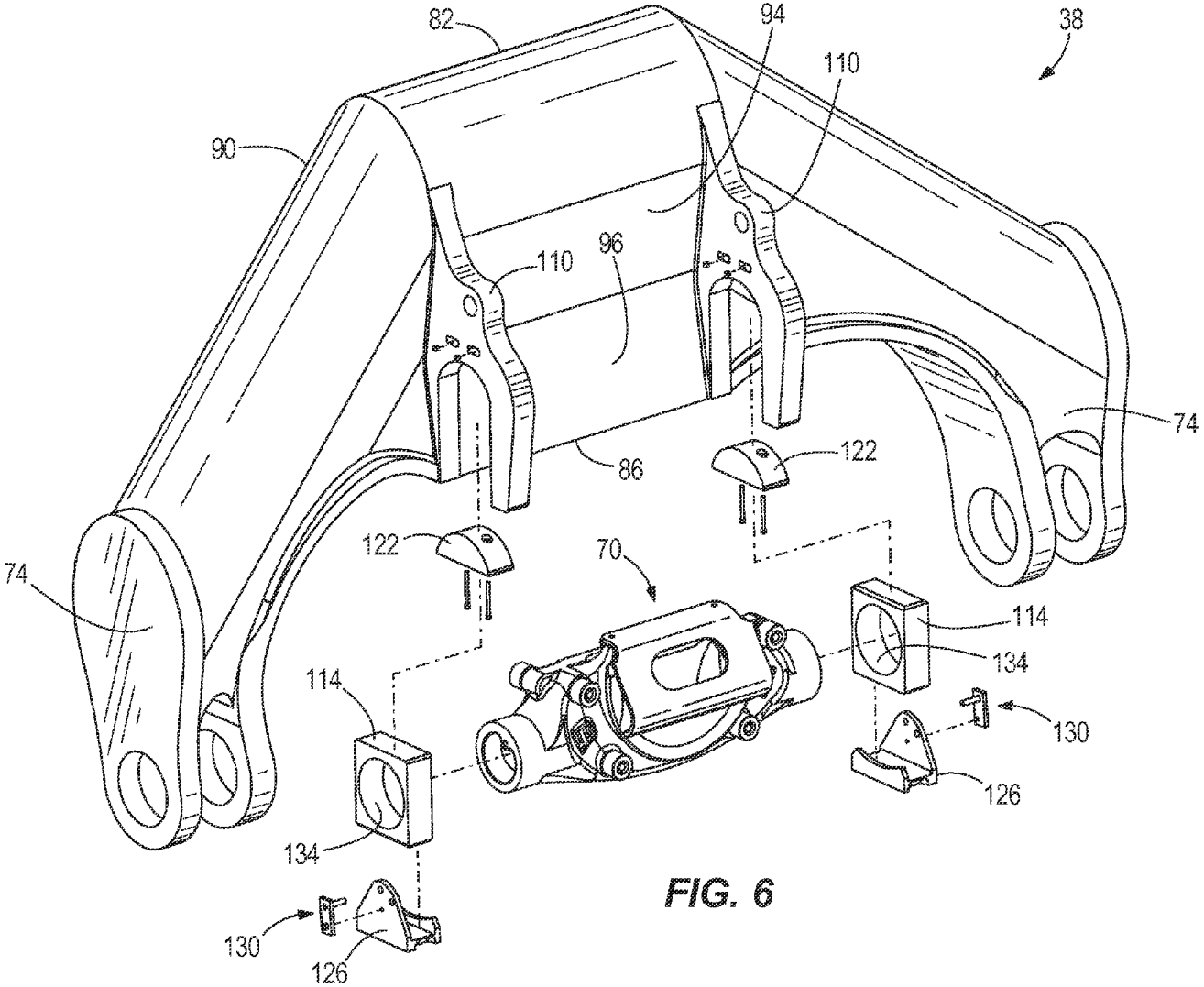
FIG. 6 is an exploded view of the bail assembly of FIG. 4.

Referring to FIG. 6, the cross-member 78 includes a pair of brackets 110 for supporting the equalizer 70. In the illustrated embodiment, the brackets 110 are arranged parallel to one another and extend or protrude from the non-bank side 94 of the central portion of the cross-member 78. That is, the brackets 110 extend in a second direction perpendicular to the bail axis 80 and away from the center portion 78*a*. The brackets 110 support bearing blocks 114 proximate the bottom edge 86 of the bail 66. The brackets 110 are open proximate the bottom edge 86 of the bail 66, permitting the equalizer 70 to be installed by inserting the equalizer in a direction from the bottom edge 86 of the bail 66 toward the top edge 82. The bearing blocks 114 support the equalizer 70 for rotation relative to the bail 66 about an equalizer axis 118 (FIGS. 4 and 5). In the illustrated embodiment shown in FIG. 5, the equalizer axis 118 is substantially aligned with the bail axis 80 when viewed along the top edge 82 of the cross-member 78. That is, the equalizer axis 118 and the bail axis 80 are horizontally aligned.

Referring again to FIG. 6, each bearing block 114 slidably engages the bracket 110 and abuts a semi-circular mount 122 that is secured to the bracket 110. The mount 122 is subject to much of the dipper loads during digging. In the illustrated embodiment, the mount 122 provides a replaceable wear element to prevent wear to the bail 66, the equalizer 70, and the bearing block 114. Once the mount 122 is coupled to the bracket 110, the bearing block 114 is positioned adjacent the mount 122. An end plate is placed over the open end of the bracket 110 and the end plate 126 is coupled to the bracket 110 by, for example, welding. The end plate 126 thereby captures the bearing block 114 against the mount 122 and the bracket 110. The bearing block 114 is not directly connected to the bracket 110, permitting slight movement of the bearing block 114. A locator member 130 is coupled to the end plate 126, and the operation of the locator member 130 is described in further detail below. In the illustrated embodiment, the bearing block 114 is a housing having an opening 134 that supports the equalizer 70 for rotation as a journal bearing. The surface of the opening 134 may be lubricated to facilitate rotation of the equalizer 70. In other embodiments, the bearing block 114 includes a roller bearing.

Figure 8:
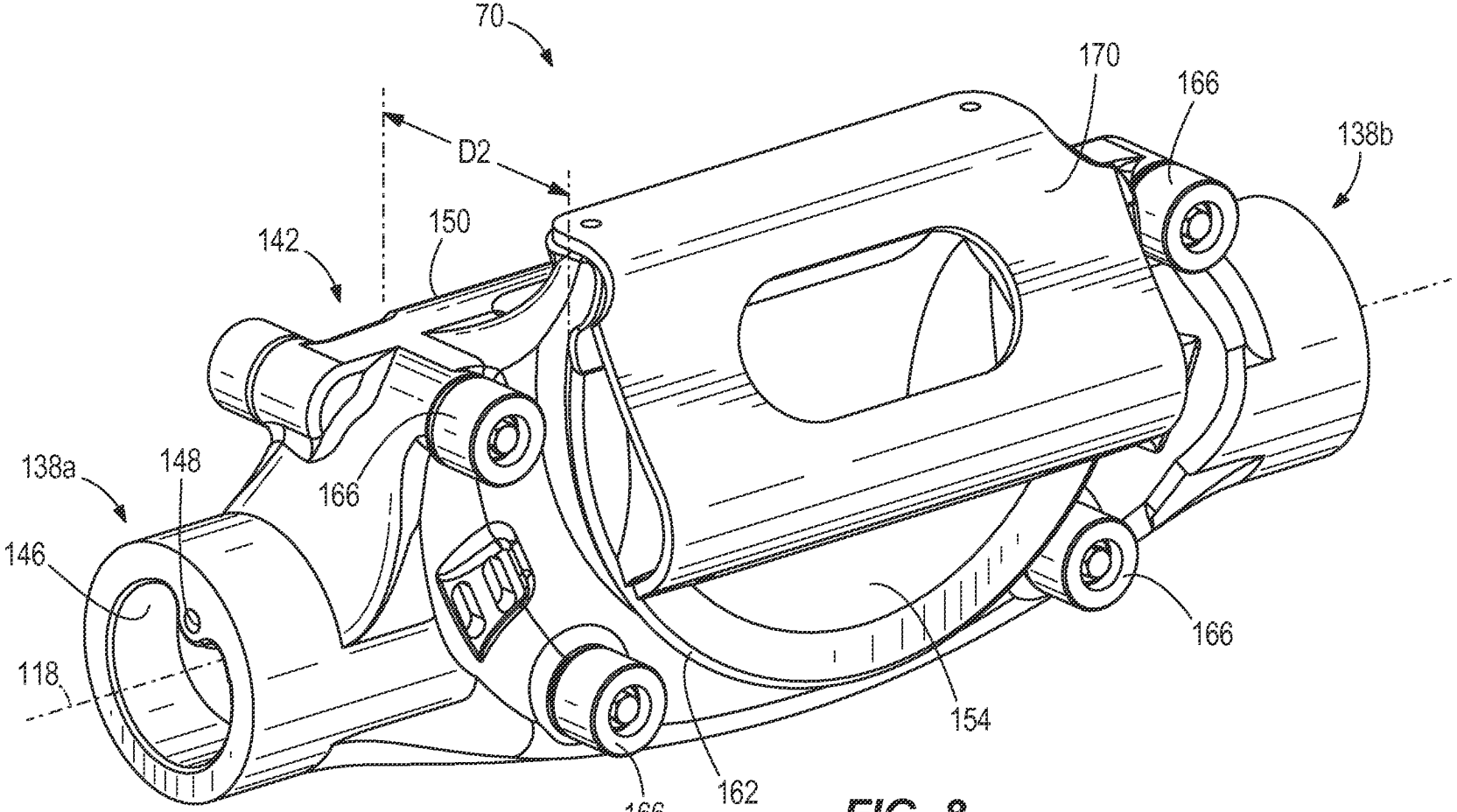
FIG. 8 is a perspective view of an equalizer.

Referring to FIG. 8, the equalizer 70 includes a pair of projections 138*a* and 138*b* and a mounting block 142 for anchoring the hoist rope 42 (FIG. 3). In the illustrated embodiment, the mounting block 142 and the projections 138 are integrally formed as a unitary piece, such as by a casting process. In other embodiments the projections 138 may be formed separately from the mounting block 142. Each projection 138 extends along the equalizer axis of rotation 118, and the first projection 138*a* extends in an opposite direction from the second projection 138*b*. Each projection 138 is received in one of the bearing block openings 134 (FIG. 6) and is supported for rotation with respect to the bearing block 114. In the illustrated embodiment, a bore 146 extends through both projections 138*a* and 138*b* and the projections 138 are formed as hollow pins, thereby reducing the weight of the equalizer 70. Further, in the illustrated embodiment, an end surface of each projection 138 includes a hole 148 for receiving the locator member 130 during the rope installation process (described below).

As shown in FIG. 9, the equalizer axis 118 is substantially parallel to the bail axis 80, and the equalizer 70 does not extend beyond the top edge 82 of the bail 66. The equalizer axis 118 is parallel to and offset from the non-bank side 94 of the bail 66. More particularly, the equalizer axis 118 is offset from the non-bank side 94 at a position that is below the top edge 82 of the bail 66. In the illustrated embodiment, the equalizer axis 118 is offset from the planar surface 96 at a position between the top edge 82 and the bottom edge 86 of the bail 66. The equalizer 70 is pivotable about the equalizer axis 118 through an angle of at least 180 degrees. The equalizer 70 is positioned proximate the non-bank side 94 throughout the range of pivoting movement. Stated another way, the equalizer axis 118 is laterally offset from the forward surface or bank side 90 of the center portion 78*a* of the cross-member 78 in a direction toward the bail axis 80. The equalizer 70 is thus positioned away from the material to be dug (i.e., the front of the shovel) during the digging operation, and the bail 66 at least partially shields the equalizer's exposure to debris from the dug material.

Referring to FIG. 8, the mounting block 142 is formed substantially in line with the projections 138 (i.e., along the equalizer axis 118) and includes a first side 150 (FIG. 9) and a second side 154. A distance between the first side 150 and the second side 154 defines an equalizer thickness D2. In the illustrated embodiment, the equalizer thickness D2 is less than the bail thickness D1, and the equalizer 70 has a narrower profile than the bail 66. In the illustrated embodiment, the first side 150 and the second side 154 each includes a semi-circular or D-shaped slot 162 for receiving the rope 42 that passes over the boom sheave 54 and rope guides 166 are positioned proximate the slot 162 to secure the rope 142 against the slot 162. The second side 154 includes a stop surface 170 that engages an outer surface of the boom sheave 54 when the bail assembly 38 is raised near the boom sheave 54. As shown in FIG. 9, the first side 150 is generally positioned proximate the non-bank side 94 of the bail cross-member 78, although rotation of the equalizer 70 about the axis 118 causes the first side 150 to move relative to the non-bank side 94.

Figure 10:
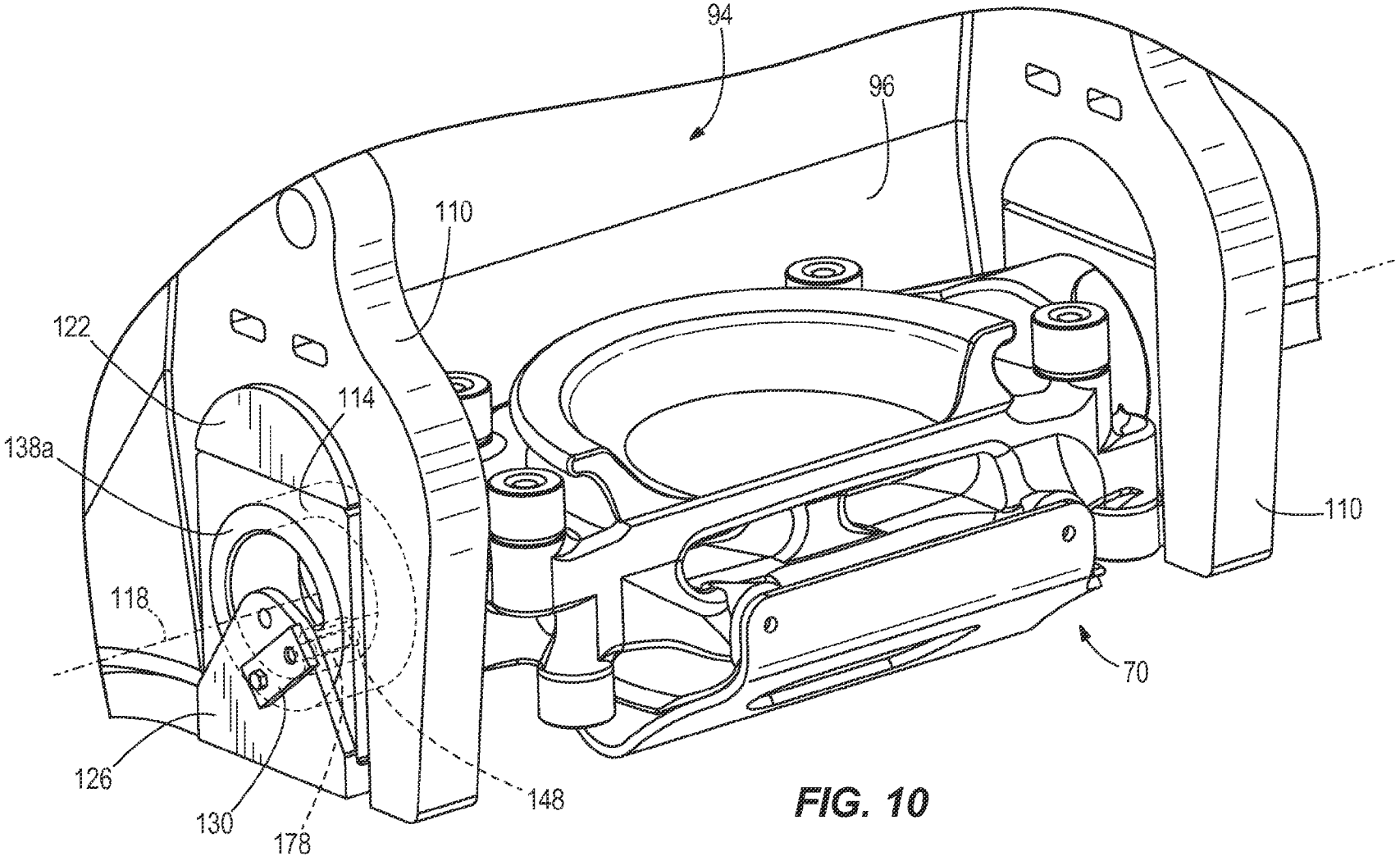
FIG. 10 is an enlarged perspective view of an equalizer coupled to a bail.

FIG. 10 illustrates the position of the equalizer 70 when the hoist rope 42 is installed around the slot 162. The locator member 130 is coupled to the end plate 126 and includes a pin 178 extending through the end plate 126 and into the hole 148 on the end of the projection 138*a*. The engagement of the pin 178 in the hole 148 secures the projection 138*a* against rotation relative to the bearing block 114 so that the equalizer 70 remains in a desired orientation relative to the bail cross-member 78 in order to facilitate installation of the hoist rope 42 onto the mounting block 142. Once installation is complete, the locking member 130 is moved so that the pin 178 extends into the bore 146 (i.e., the locator member 130 is positioned in a substantially vertical orientation as shown in FIG. 10) and does not engage the projection 138*a*.

Figure 11:
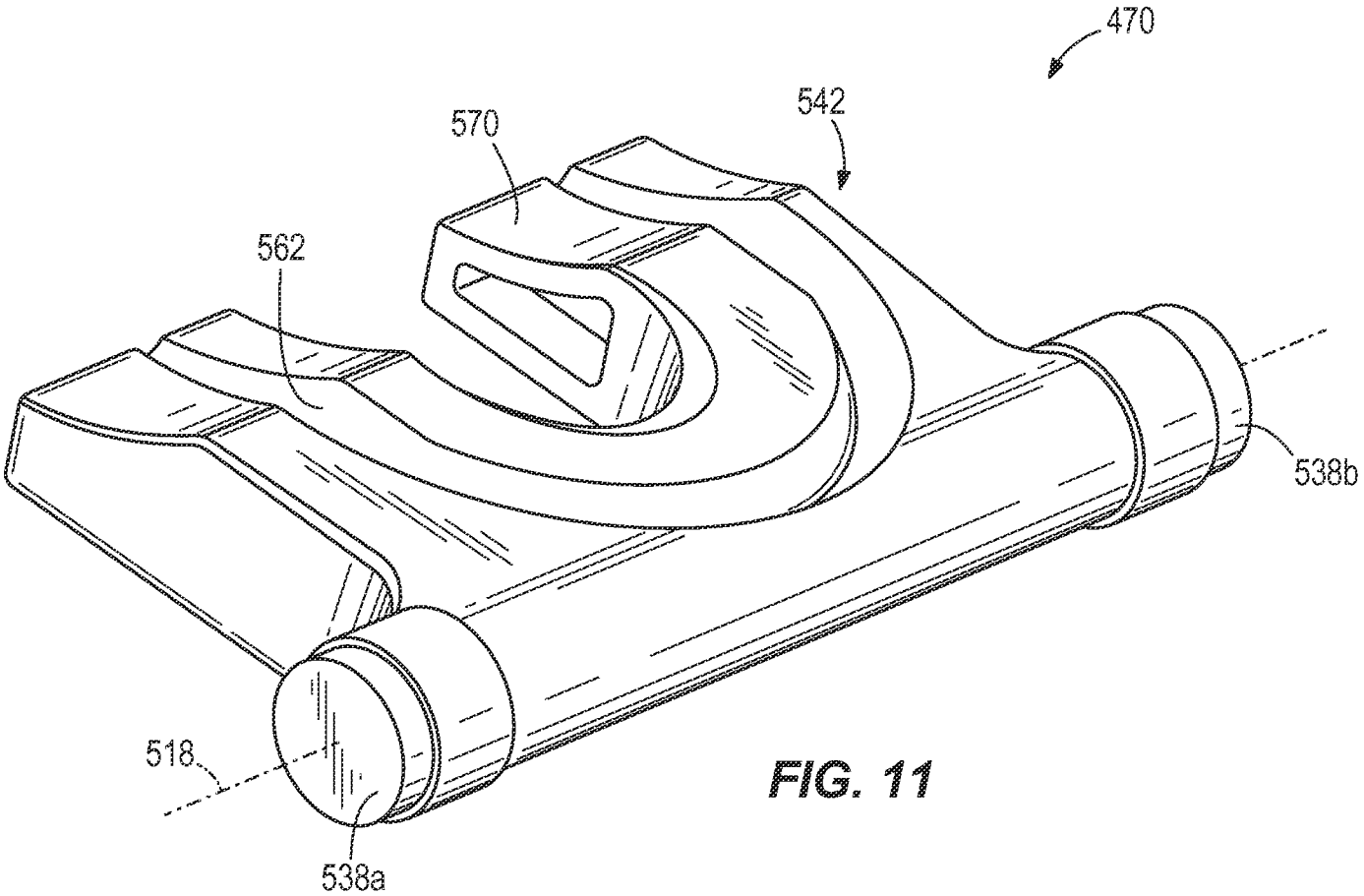
FIG. 11 is a perspective view of an equalizer according to another embodiment.

FIG. 11 illustrates another embodiment of the equalizer 470, and similar features are indicated with similar reference numbers, plus 400. The equalizer 470 includes projections 538*a* and 538*b* defining an equalizer axis 518 and a mounting block 542. The mounting block 542 is formed integrally with the projections 538*a* and 538*b* but the mounting block 542 is generally offset from the equalizer axis 518.

Referring again to FIG. 3, the equalizer 70 is positioned on the non-bank side 94 of the bail 66, allowing the equalizer 70 to pivot toward the boom sheave 54. The narrow profile of the mounting block 142 compared to conventional mounting blocks 142 reduces the fleet angle, or the angle defined between the mounting block 142 and the rope 42 extending from the outer surface of the boom point sheave 54. This results in less pinching or kinking of the rope 42 against the mounting block 142 when the bail assembly 38 is hoisted close to the boom point sheave 54. The geometry of the mounting block 142 and the projections 138 allows the mounting block 142 to closely align with the sides 90, 94 of the bail cross-member 78 and reduce the rope fleet angle. Furthermore, because the mounting block 142 is positioned below the top edge 82 of the bail 66, the equalizer 70 has a relatively low height compared to the bail 66, improving the dig and dump heights and cutting forces of the dipper 36. The equalizer 70 of FIG. 10 provides the same benefits as those described above.

The mounting block 142 and projections 138 reduce the size and weight of the bail assembly 38, thereby increasing the cutting force of the dipper 36. The compact design of the equalizer 70 reduces the dig and dump heights of the dipper 36, especially when compared to prior art bail assemblies. The equalizer 70 reduces the fleet angle, thereby reducing wear on the hoist rope 42. The equalizer 70 also provides an additional pivot point that allows the hoist rope 42 to remain aligned along a tangent to the boom point sheave 54 even when the bail 66 and rope 42 are in a relaxed or slack state. The projections 138 provide a large bearing surface that engages the blocks 114 and improves the life of the bail 66. The integrally-formed mounting block 142 and projections 138 can be uncoupled from the bail 66, permitting simple replacement of the equalizer 70. In addition, the bail assembly 38 facilitates maintenance and replacement of the hoist ropes 42 compared to dippers that include only a bail or only an equalizer. In some embodiments, the equalizer 70 lasts at least one year.

Thus, the invention provides, among other things, a hoist system for an industrial machine. Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A bail assembly for a mining shovel, the shovel including at least one hoist rope supporting a dipper, the bail assembly comprising:

a bail configured to be coupled to the dipper, the bail pivotable about a bail axis, the bail including a cross-member defining an upper edge, a lower edge, a first side extending between the upper edge and the lower edge, and a second side extending between the upper edge and the lower edge; and an equalizer configured to receive a portion of every hoist rope supporting the dipper such that the portion of each hoist rope is positioned adjacent the second side of the cross-member and on an opposite side from the first side of the cross-member, the equalizer pivotable about an equalizer axis that is parallel to the bail axis, the equalizer axis being offset from the second side and the equalizer axis positioned between the upper edge and the bail axis.

2. The bail assembly of claim 1, wherein the second side of the cross-member is opposite the first side, wherein the equalizer is coupled to a center portion of the bail.

3. The bail assembly of claim 1, wherein the cross-member includes at least one support bracket, each support bracket including an opening positioned proximate the lower edge of the cross-member, wherein the equalizer is coupled to the bail by inserting at least a portion of the equalizer into the opening of the at least one support bracket.

4. The bail assembly of claim 1, wherein the cross-member is laterally offset from the bail axis in a first direction perpendicular to the bail axis, wherein the bail includes at least one support bracket extending away from the second side in a second direction, the support bracket supporting the equalizer for pivotal movement relative to the bail.

5. The bail assembly of claim 4, wherein the bail includes two support brackets, the equalizer including a first projection supported for rotation by one of the support brackets and a second projection supported for rotation by the other of the support brackets.

6. The bail assembly of claim 5, wherein the equalizer is coupled to the support brackets by inserting the first projection and the second projection into openings that open toward the lower edge of the cross-member.

7. The bail assembly of claim 1, wherein the bail includes a pair of arms, the cross-member extending between the arms, the cross-member having a first thickness, and wherein the equalizer includes a first side and a second side spaced apart from the first side of the equalizer, the equalizer defining a second thickness that is less than the first thickness.

8. The bail assembly of claim 1, wherein the equalizer is positioned proximate the second side of the cross-member throughout the range of pivoting movement.

9. The bail assembly of claim 1, wherein the bail includes a pair of arms configured to be coupled to the dipper and the cross-member extends between the arms, the cross-member including a first end portion proximate one of the arms, a second end portion proximate the other arm, and a center portion positioned between the first and second end portions, the center portion laterally offset from the arms such that the first end portion and second end portion extend at an angle relative to the bail axis.

10. The bail assembly of claim 1, wherein the bail axis and the equalizer axis lie in a common plane, wherein a center portion of the cross-member is offset from the plane, the cross-member further including a first end portion and a second end portion, the first end portion positioned adjacent one end of the center portion and extending laterally at an acute angle relative to the bail axis, the second end portion positioned adjacent an opposite end of the center portion and extending laterally at an acute angle relative to the bail axis.

11. The bail assembly of claim 1, wherein a bail plane extends between the upper edge of the cross-member and the bail axis, and wherein the equalizer axis is spaced apart from the bail plane.

12. The bail assembly of claim 1, wherein the resultant tensile force exerted by every hoist rope supporting the dipper is exerted on the equalizer and creates a moment on the bail about the bail pin in a first direction.

13. A bail assembly for a mining shovel, the shovel including at least one hoist rope supporting a dipper, the bail assembly comprising:

a bail including a pair of arms configured to be coupled to the dipper and a cross-member extending between the arms, the bail being pivotable about a bail axis, the cross-member defining a center portion including a first side and a second side opposite the first side, the second side offset from the bail axis in a first direction perpendicular with respect to the bail axis; and an equalizer configured to receive a portion of every hoist rope supporting the dipper such that the portion of each hoist rope is positioned adjacent the second side of the cross-member, the equalizer being pivotably coupled to the bail, the equalizer pivotable about an equalizer axis that is offset from the second side of the center portion of the cross-member in a second direction.

14. The bail assembly of claim 13, wherein the second side is positioned laterally closer to the bail axis than the first side, and wherein the bail further includes at least one support bracket protruding from the second side, the at least one support bracket supporting the equalizer for pivotal movement relative to the bail.

15. The bail assembly of claim 13, wherein the bail includes two support brackets, wherein the equalizer includes a first projection extending along the equalizer axis in a first direction and a second projection extending along the equalizer axis in a second direction opposite the first direction, wherein the first projection is rotatably supported by one of the support brackets and the second projection is rotatably supported by the other of the support brackets.

16. The bail assembly of claim 15, wherein the equalizer is coupled to the support brackets by inserting the first projection and the second projection into openings that open toward a lower edge of the cross-member.

17. The bail assembly of claim 13, wherein the second side is spaced apart from the first side, the first side and the second side define a bail thickness therebetween, and wherein the equalizer includes a first side and a second side spaced apart from the first side of the equalizer and defines an equalizer thickness therebetween, wherein the equalizer thickness is less than the bail thickness.

18. The bail assembly of claim 13, wherein the second side of the center portion is opposite the first side and laterally proximate the bail axis, wherein the equalizer is positioned proximate the second side throughout the range of pivoting movement.

19. The bail assembly of claim 13, wherein the cross-member defines an upper edge and a bail plane extends between the upper edge and the bail axis, wherein the equalizer axis is spaced apart from the bail plane.

20. A dipper assembly for a mining shovel, the shovel including at least one hoist rope extending over a boom and supporting the dipper assembly to raise and lower the dipper assembly, the dipper assembly comprising:

a dipper including a dipper body and a dipper door, the dipper body defining a material receiving end and a material discharging end, the dipper door pivotably coupled to the dipper body to selectively close the material discharging end;

a bail including a first arm, a second arm, and a cross-member extending at least partially between the first arm and the second arm, each arm coupled to the dipper body proximate the material receiving end, the cross-member defining a first side and a second side opposite the first side, the bail pivotable about a bail axis; and an equalizer configured to receive a portion of each hoist rope supporting the dipper such that the portion of each hoist rope is positioned adjacent the second side of the cross-member and on an opposite side from the first side of the cross-member, the equalizer being pivotably coupled to the bail, the equalizer pivotable about an equalizer axis that is parallel to the bail axis and is laterally offset from the second side.

21. The dipper assembly of claim 20, wherein the equalizer is coupled to a center portion of the bail on the second side opposite the first side.

22. The dipper assembly of claim 20, wherein the cross-member is laterally offset from the bail axis in a first direction, wherein the bail includes at least one support bracket extending away from the cross-member in a second direction, the support bracket supporting the equalizer for pivotal movement relative to the bail.

23. The dipper assembly of claim 22, wherein the bail includes two support brackets, the equalizer including a first projection supported for rotation by one of the support brackets and a second projection supported for rotation by the other of the support brackets, wherein the equalizer is coupled to the support brackets by inserting the first projection and the second projection into openings that open toward the lower edge of the cross-member.

24. The dipper assembly of claim 20, wherein the cross-member has a first thickness, and wherein the equalizer includes a first side and a second side spaced apart from the first side of the equalizer, the equalizer defining a second thickness that is less than the first thickness.

25. The dipper assembly of claim 21, wherein the equalizer is positioned proximate the second side of the cross-member throughout the range of pivoting movement.

26. The dipper assembly of claim 20, wherein the cross-member includes a first end portion proximate the first arm, a second end portion proximate the second arm, and a center portion positioned between the first and second end portions, the center portion positioned forward with respect to the end portions.

27. The dipper assembly of claim 20, wherein the bail axis and the equalizer axis lie in a common plane, wherein the center portion of the cross-member is offset from the plane.

28. The dipper assembly of claim 20, wherein the equalizer is laterally offset from the center portion of the cross-member when viewed along the equalizer axis.

29. The dipper assembly of claim 20, wherein the dipper body defines a digging edge extending around a portion of the material receiving opening, wherein the first side of the cross-member is positioned proximate the digging edge and the second side is positioned away from the digging edge, wherein the equalizer is coupled to the second side of the cross-member.

* * * * *